US010851624B2

(12) United States Patent
Allison

(10) Patent No.: US 10,851,624 B2
(45) Date of Patent: Dec. 1, 2020

(54) PERFORATING GUN ASSEMBLY AND METHODS OF USE

(71) Applicant: DELPHIAN BALLISTICS LIMITED, Aberdeen (GB)

(72) Inventor: Simon Douglas Eardly Allison, Aberdeen (GB)

(73) Assignee: Delphian Ballistics Limited, Aberdeen (GB)

( * ) Notice: Subject to any disclaimer, the term of this patent is extended or adjusted under 35 U.S.C. 154(b) by 184 days.

(21) Appl. No.: 15/748,297

(22) PCT Filed: Jul. 28, 2016

(86) PCT No.: PCT/GB2016/052330
§ 371 (c)(1),
(2) Date: Jan. 29, 2018

(87) PCT Pub. No.: WO2017/017467
PCT Pub. Date: Feb. 2, 2017

(65) Prior Publication Data

US 2018/0216446 A1 Aug. 2, 2018

(30) Foreign Application Priority Data

Jul. 28, 2015 (GB) ..... 1513269.9

(51) Int. Cl.
*E21B 43/117* (2006.01)
*E21B 43/26* (2006.01)
(Continued)

(52) U.S. Cl.
CPC ..... *E21B 43/117* (2013.01); *E21B 43/119* (2013.01); *E21B 43/26* (2013.01); *E21B 23/001* (2020.05)

(58) Field of Classification Search
CPC ..... E21B 2023/008; E21B 43/117; E21B 43/119; E21B 43/26
See application file for complete search history.

(56) References Cited

U.S. PATENT DOCUMENTS 2,679,898 A 6/1954 Forsyth et al.
3,347,314 A 10/1967 Schuster
(Continued)

FOREIGN PATENT DOCUMENTS

RU 2 473 788 1/2013
WO WO 2013/019390 2/2013
(Continued)

OTHER PUBLICATIONS

International Search Report and Written Opinion of the ISA for PCT/GB2016/052330, dated Nov. 7, 2016, 13 pages.

*Primary Examiner* — Daniel P Stephenson
(74) *Attorney, Agent, or Firm* — FisherBroyles, LLP

(57) ABSTRACT

In one aspect, the method comprises providing a perforating gun assembly having a first group of shaped charges on first longitudinal portion of the assembly and a second group of shaped charges on a second longitudinal portion of the assembly. The orientations of the first and second groups are rotationally offset from one another around a longitudinal axis of the perforating gun assembly. The method comprises locating the perforating gun assembly in a wellbore with the first group of shaped charges adjacent a wall of the wellbore at a perforation location, and detonating the shaped charges to form a first perforation channel in the wellbore with a defined first fracture initiation point. The perforating gun assembly is translated in the wellbore to locate the second group of shaped charges oriented towards a defined second fracture initiation point, at a desired axial position with respect to the first fracture initiation point.

24 Claims, 8 Drawing Sheets

(51) Int. Cl.
*E21B 43/119* (2006.01)
*E21B 23/00* (2006.01)

(56) References Cited

U.S. PATENT DOCUMENTS

| | | | | |
|---|---|---|---|---|
| 3,695,368 | A | 10/1972 | Lanmon, II | |
| 3,706,340 | A | 12/1972 | Schuster | |
| 7,172,023 | B2 | 2/2007 | Barker et al. | |
| 7,303,017 | B2 | 12/2007 | Barker et al. | |
| 7,409,992 | B2 | 8/2008 | Zazovsky et al. | |
| 8,327,746 | B2 | 12/2012 | Behrmann et al. | |
| 9,441,438 | B2 * | 9/2016 | Allison | E21B 29/02 |
| 2003/0188867 | A1 * | 10/2003 | Parrott | E21B 17/05 166/297 |
| 2005/0194146 | A1 * | 9/2005 | Barker | E21B 43/119 166/298 |
| 2006/0118303 | A1 * | 6/2006 | Schultz | E21B 43/088 166/297 |
| 2006/0289167 | A1 * | 12/2006 | Surjaatmadja | E21B 43/114 166/308.1 |
| 2007/0158109 | A1 | 7/2007 | Zazovsky et al. | |
| 2009/0242198 | A1 * | 10/2009 | Evans | E21B 43/119 166/250.01 |
| 2014/0020896 | A1 | 1/2014 | Abdullah | |
| 2015/0226043 | A1 * | 8/2015 | Hardesty | E21B 43/117 166/297 |
| 2015/0368996 | A1 * | 12/2015 | Allison | E21B 29/02 166/297 |
| 2018/0216446 | A1 * | 8/2018 | Allison | E21B 43/119 |

FOREIGN PATENT DOCUMENTS

| | | |
|---|---|---|
| WO | WO 2013/173404 | 11/2013 |
| WO | WO 2016/046521 | 3/2016 |

* cited by examiner

PERFORATING GUN ASSEMBLY AND METHODS OF USE

This application is the U.S. national phase of International Application No. PCT/GB2016/052330 filed Jul. 28, 2016, which designated the U.S. and claims priority to GB Patent Application No. 1513269.9 filed Jul. 28, 2015, the entire contents of each of which are hereby incorporated by reference.

The present invention relates to a perforating gun assembly and a method of use in perforating and/or hydraulic fracturing applications. In particular, but not exclusively, the invention relates to a perforating gun assembly comprising convergent shaped charge orientations and a method of use in a perforating operation prior to fracture initiation. Aspects of the invention relate to hydraulic fracturing methods.

BACKGROUND TO THE INVENTION

In the hydrocarbon exploration and production industry, it is common to use perforating guns to form fluid communication paths ("perforations") in a subterranean formation between a hydrocarbon reservoir and a drilled wellbore that traverses the reservoir. The communication paths enable the inflow of production fluids into the wellbore, and enable the delivery of stimulation fluids to the formation, for example during hydraulic fracturing operations. Typically perforating methods are applied to cased hole wellbores, which include a casing string cemented within the wellbore to increase the integrity of the wellbore and provide a flow path to surface for fluids produced from the formation. The perforations extend through the steel casing, the cement on the outside of the casing, and into the formation. Similar methods are used in the fields of water and geothermal exploration.

It is conventional to form the perforations by placing a perforating gun which incorporates shaped charges inside the casing string next to the formation to be perforated. A typical perforating gun comprises a charge carrier and a series of shaped charges connected to a detonator by a detonation cord. The perforating gun forms a part of a tool string which is conveyed into the wellbore by a flexible line, drill string, coiled tubing, or other conveyance. Commonly, flexible line such as wireline, electric line or slickline is used to convey the perforating gun to the required wellbore depth. With the charge carriers located in the interval to be perforated, the shaped charges are detonated to generate high-pressure streams of particles in the form of jets. The jets penetrate through the casing, the cement and into the formation. The shaped charge weights, design, and orientation determine the size, depth of penetration and direction of the resulting perforation geometry.

Various factors contribute to the effect of the perforations on the productivity of the well or the success of a fracturing operation. These include depth and effective diameter of perforation tunnels. One technique for generating perforations with improved inflow characteristics is to use groups or banks of convergent or focused shaped charges. U.S. Pat. Nos. 3,347,314, 7,303,017, 7,172,023 and 7,409,992 are examples of perforating devices which used convergent charge groups to create an enhanced perforation cavity.

In longer perforation intervals, fracture tortuosity and multiple fracture events, both of which hamper the design objective of Limited Entry, can be prevalent. The issues are exacerbated in high angle or horizontal wells where regional (tectonic) stress effects dominate the fracture growth pattern, with the perforation itself being a secondary factor. Limiting the perforation interval to a very short section (for example as low as 1 ft to 2 ft or 0.3 m to 0.6 m) can have benefits towards reducing the fracture tortuosity and multiple fracture events, and facilitating Limited Entry fracturing, particularly in high angle or horizontal wells. Convergent charge configurations can go some way to achieving Limited Entry, but disadvantages of convergent charge configurations of the types described in U.S. Pat. Nos. 3,347,314, 7,303,017, 7,172,023 and 7,409,992 result from the requirement for the shaped charges to operate in functional groups. This places restrictions on shaped charge placement and phasing, which can have an adverse effect on production flow geometry in a radial direction around the wellbore.

U.S. Pat. No. 3,695,368 discloses a perforating method for production enhancement which uses a perforator with one or more sets of longitudinally spaced charges. After a first perforation is formed, the tool is axially repositioned before detonation of a second charge. The second charge forms a perforation contiguous with the first perforation.

RU 2473788 describes an alternative method of forming a wellbore perforation in a two-stage process for improved in-flow of production fluids. In a first perforating cycle, either deep hole or big hole perforations are formed by detonation of deep hole or big hole shaped charges at a particular wellbore location. The perforating tool is removed and reloaded with deep hole or big hole charges (which may be the same or different from the charges used in the first perforation cycle). The reloaded gun is run into hole and in a second perforating cycle, the charges are detonated at the same wellbore location.

WO2013/019390 describes a fracturing method which uses a tool with multiple convergent charge groups to create discrete fracture initiation sites at distinct locations, by repositioning the tool between detonations.

US2014/0020896 describes a method and apparatus for conducting multiple successive firings of perforating guns at a particular location in an openhole wellbore. The described method places a gun with n shaped charges at a particular location in the openhole and detonates the charges to create openings which penetrate the formation. The gun is retrieved and a reloaded (or second) gun is run to the same location to align n−1 charges with the openings. The method is repeated to provide relatively deep perforations which bypass the near-wellbore damaged formation and which are stated to be suitable for fracture initiation.

U.S. Pat. No. 2,679,898 describes an oriented gun perforating method which uses an orienting means to enable two groups of perforations to be placed in a desired spaced position with respect to one another.

SUMMARY OF THE INVENTION

It is amongst the aims and objects of the invention to provide a perforating gun assembly and a method of use in perforating and/or hydraulic fracturing applications which is an alternative to the methods and apparatus described above.

It is amongst the aims and objects of the invention to provide a perforating gun assembly and a method of use in perforating and/or hydraulic fracturing applications which obviates or mitigates drawbacks and deficiencies of previously proposed apparatus and methods.

It is amongst the aims and objects of the invention to provide a perforating gun assembly and a method of use in perforating and/or hydraulic fracturing applications which provides improved perforation connectivity and/or fracture initiation.

An aim of an aspect and embodiment of the invention is to provide a perforating gun assembly and a method of use in perforating and/or hydraulic fracturing applications which provides discrete fracture initiation sites with improved placement control.

Additional aims and objects of the invention will become apparent from reading the following description.

According to a first aspect of the invention, there is provided a method of perforating a wellbore in a hydraulic fracturing operation, the method comprising:

providing a perforating gun assembly comprising a first group of shaped charges on a first longitudinal portion of the assembly and a second group of shaped charges on a second longitudinal portion of the assembly, wherein the first group of shaped charges comprises at least two shaped charges arranged to generate jets oriented substantially along respective axes that converge towards one another in a first convergence plane, and wherein the second group of shaped charges comprises at least two shaped charges arranged to generate jets oriented substantially along respective axes that converge towards one another in a second convergence plane, and wherein the first and second planes of convergence are rotationally offset from one another around a longitudinal axis of the perforating gun assembly;

locating the perforating gun assembly in a wellbore with the first group of shaped charges adjacent a wall of the wellbore at a perforation location;

detonating the shaped charges of the first group of shaped charges to form a first perforation channel in the wellbore with a defined first fracture initiation point;

translating the perforating gun assembly in the wellbore to locate the second group of shaped charges adjacent the wellbore at the perforation location such that the position of the second group of shaped charges orients the shaped charges towards a defined second fracture initiation point; and detonating the shaped charges of the second group of shaped charges to form a second perforation channel in the wellbore which overlaps with the first perforation channel in an axial direction of the wellbore, which is rotationally offset from the first perforation channel around a longitudinal axis of the wellbore, and which forms a defined second fracture initiation point at a desired axial position with respect to the first fracture initiation point.

The rotational offset between the first and second convergence planes of the first and second groups of charges enables placement of perforation channels at distinct azimuthal angles, where both channels cross cut a fracture plane. The method is not limited by gun geometry or size.

The first and second convergence planes may be at any selected angle between 0 and 360 degrees. In an embodiment, the first and second planes may be phased at 180 degrees. In other words, the first and second planes may be oriented so that the respective perforation channels are phased at 180 degrees to one another. Alternatively, the first and second planes may be oriented at an angle between 0 and 180 degrees, or an angle between 180 degrees and 360 degrees.

The wellbore may be an openhole wellbore, but in preferred embodiments is a cased or lined wellbore.

The first and/or second perforation channels may be formed by the detonation of large holes in a first detonation event, and the detonation of deep penetrating charges in a subsequent detonation event. The method may comprise the step of detonating deep penetrating shaped charges to generate jets which pass through one or more large holes formed in a previous detonation event. The method may form at least two deep penetration holes in the formation adjacent the perforation location, wherein the least two deep penetration holes intersect to provide a connected channel in the formation.

The method may comprise forming at least one of the first or second perforation channels by detonating one or more large hole shaped charges, translating the perforating gun assembly, and detonating deep penetrating shaped charges to generate jets which pass through one or more large holes formed by the large hole shaped charges.

The method may comprise providing a third group of shaped charges, and detonating the shaped charges of the third group of shaped charges to form a third perforation channel in the wellbore with a defined third fracture initiation point. Preferably the third group of shaped charges is on the same perforating gun assembly as the first and second groups of shaped charges. The method may comprise translating the perforating gun assembly in the wellbore to locate the third group of shaped charges adjacent the wellbore at the perforation location such that the position of the third fracture initiation point at a desired axial position with respect to the first and second fracture initiation point. The method may be repeated for fourth and/or further groups of shaped charges and fraction initiation points. Therefore the method may provide a means of creating a plurality of fracture initiation points at desired axial position by translation of a gun assembly between detonation events. One or more of the desired axial positions may be on a preferred fracture plane. The desired axial positions may be in a plane perpendicular to the main axis of the wellbore.

According to a second aspect of the invention, there is provided a method of perforating and fracturing a wellbore, the method comprising:

carrying out the method of the first aspect of the invention;

pumping a fracturing fluid into the wellbore to the perforation location and into the perforation channels; and initiating and propagating a fracture from the first and second fracture initiation points.

The terms "upper", "lower", "above", "below", "up" and "down" are used herein to indicate relative positions in the wellbore. The invention also has applications in wells that are deviated or horizontal, and when these terms are applied to such wells, they may indicate "left", "right" or other relative positions in the context of the orientation of the well.

Embodiments of the second aspect of the invention may include one or more features of the first aspect of the invention or its embodiments, or vice versa.

According to a third aspect of the invention, there is provided a perforating gun assembly comprising:

a first group of shaped charges on a first longitudinal portion of the assembly, the first group of shaped charges comprising at least two shaped charges arranged to generate jets oriented substantially along respective axes that converge towards one another in a first convergence plane;

a second group of shaped charges on a second longitudinal portion of the assembly, the second group of shaped charges comprising at least two shaped charges arranged to generate jets oriented substantially along respective axes that converge towards one another in a second convergence plane;

a first detonator for detonating the shaped charges of the first group of shaped charges to form a first perforation channel in a wellbore with a defined first fracture initiation point; a second detonator for detonating the shaped charges of the second group of shaped charges to form a second perforation channel in the wellbore with a defined second, fracture initiation point, wherein the second perforation channel overlaps with the first perforation channel in an axial direction of the wellbore;

an anchor for securing the perforating gun assembly in the wellbore with the first group of shaped charges adjacent the wellbore at a perforation location; and a positioning and alignment module configured to translate the perforating gun assembly in the wellbore to a second axial position, which locates the second group of shaped charges adjacent the wellbore at the perforation location such that the position of the second group of shaped charges orients the shaped charges towards a defined second fracture initiation point;

wherein the first and second planes of convergence are rotationally offset from one another around a longitudinal axis of the perforating gun assembly;

and wherein, in the second axial position, the second group of shaped charges are oriented to form a second perforation channel in the wellbore which overlaps with the first perforation channel in an axial direction of the wellbore, which is rotationally offset from the first perforation channel around a longitudinal axis of the wellbore, and which forms a defined second fracture initiation point at a desired axial position with respect to the first fracture initiation point.

The first and second detonators may form a part of a single detonation system, for example a select fire detonation system, or may be separate and distinct detonators.

The first and/or second groups of shaped charges may form a part of first and/or second collections of shaped charges on the first and/or second longitudinal portions respectively. Each collection may comprise more than one group of shaped charges which interacts to form a perforation channel.

At least two shaped charges within each group may be arranged to generate jets oriented substantially along respective axes that converge towards one another. The at least two groups of shaped charges of the first or the second longitudinal portions of the assembly may therefore be intermeshed or interlaced in a longitudinal direction of the assembly.

The assembly may comprise at least two groups of shaped charges rotationally offset or phased around the longitudinal axis of the gun module.

One or more groups of shaped charges may be arranged in a line parallel to the longitudinal axis of the gun module. Preferably each group of shaped charges is arranged in a line parallel to the longitudinal axis of the gun module.

In one example, the assembly comprises first and second groups of shaped charges to form first and second perforation channels which overlap one another and are rotationally offset by 180 degrees. In this example, the first and second perforation channels may have first and second major diameters oriented substantially in the same plane.

The use of convergent shaped charges which overlap one another has benefits in hydraulic fracturing applications. The perforation channels formed by the inventive assembly are more closely aligned which aids fracture growth and placement control, as fracture initiation points are positioned axially close to one another. An additional unexpected benefit is improved gun survivability as a result of the overlapping, and optional phasing, of groups of convergent shaped charges. The intermeshing of charges promotes the distribution and dissipation of shock wave forces through the perforating gun assembly, and increases the integrity of the perforating gun assembly and tool string without compromises regarding charge placement, charge capacity, or material and manufacturing costs.

Preferably the perforating gun assembly also comprises a housing, and the charge carrier is disposed within the housing. The housing may comprise a substantially cylindrical member, which may define a cylindrical bore in which the charge carrier is disposed. The charge carrier may be co-axial with the housing.

In the context of this description, the term "housing" is used to refer to an outer housing or casing of the perforating gun assembly, and the term "charge carrier" is used to describe a structure to which the shaped charges are mounted (directly or indirectly) in their desired groupings and/or orientations.

The perforating gun assembly may comprise an anchor for securing the assembly in a cased or lined wellbore.

The assembly may comprise a positioning and alignment module configured to translate the perforating gun assembly in the wellbore.

The assembly may comprise a guide shaft and a guide housing, the guide shaft being movable within the guide housing to translate the perforating gun assembly in the wellbore. The guide shaft may be movable from a first position, in which the first gun module is adjacent the casing or liner at a perforation location; and a second position in which the second gun module is adjacent the casing or liner at the perforation location such that the position of the second group of shaped charges corresponds a desired axial position with respect to a detonation position of the first group of shaped charges.

Preferably, the positioning and alignment module comprises one or more guide keys co-operating with one or more guide keyways.

Preferably, the positioning and alignment module comprises one or more shear pins, which may be configured to maintain the guide shaft in its first position. The shear pins may be configured to be sheared by a force applied to the assembly.

The method may comprise assisting the translation of the perforating gun assembly using a spring.

The method may comprise translating the perforating gun assembly by applying a force to at least a portion of the perforating gun assembly. The force may be a motive force from a downhole tractor, which may form a part of the perforating gun assembly. Alternatively, or in addition, the motive force may be a tensile force or a compressive force or downweight applied from surface.

The assembly may comprise at least one sealed chamber, and the method may comprise breaking or rupturing a seal to the sealed chamber.

The sealed chamber, which may be pressure isolated from the wellbore, may comprise a liquid filled chamber in a first condition. The liquid filled chamber may prevent translation of the perforating gun assembly with respect to the anchor in its first condition.

The method may comprise breaking or rupturing a seal to the sealed chamber to enable liquid to be expelled from the chamber. The method may comprise expelling liquid from the chamber during translation of the perforating gun assembly with respect to the anchor.

The method may comprise breaking or rupturing a seal by detonation of the first gun module.

The seal may comprise a rupture disc.

The method may comprise translating the perforating gun assembly by applying a force to at least a portion of the perforating gun assembly, wherein the force is applied by exposing at least a portion of the gun assembly to a wellbore pressure.

The perforating gun assembly may comprise a pressure chamber, which in its first condition is sealed and isolated from a wellbore pressure, and is at a pressure lower than a wellbore pressure. The pressure chamber may be filled with air at atmospheric pressure.

The method may comprise exposing the pressure chamber to wellbore pressure, thereby causing wellbore fluids to enter the chamber. The method may comprise exposing at least a portion of the positioning and alignment module to wellbore pressure, to actuate movement of the guide shaft in the guide housing, and thereby translate the perforating gun assembly. The method may comprise exposing at least a portion of the positioning and alignment module to wellbore pressure by detonation of the first gun module.

Embodiments of the third aspect of the invention may include one or more features of the first or second aspects of the invention or their embodiments, or vice versa.

According to a fourth aspect of the invention, there is provided a perforating gun assembly comprising:

a charge carrier having a longitudinal axis;

a first group of shaped charges comprising at least two shaped charges arranged to generate jets oriented substantially along respective axes that converge towards one another in a first convergence plane to a first focal point;

a second group of shaped charges comprising at least two shaped charges arranged to generate jets oriented substantially along respective axes that converge towards one another in a second convergence plane to a second focal point;

wherein in at least one of the groups of shaped charges, a convergence angle between the orientation direction of two shaped charges within the group is selected to locate its focal point at a position which is axially offset from an axial midpoint between the outermost charges in the group.

Preferably, in a first group of shaped charges, a convergence angle between the orientation direction of two shaped charges within the first group is selected to locate its focal point at an axial position closer to a second group of charges than a midpoint of the first group.

Preferably, convergence angles of charges within the group are asymmetrical.

Convergence angles of charges within first and second groups may be selected to place their respective focal points closer to one another than their respective midpoints.

The at least two groups of shaped charges may be intermeshed or interlaced in a longitudinal direction of the charge carrier.

Embodiments of the fourth aspect of the invention may include one or more features of the first to third aspects of the invention or their embodiments, or vice versa.

According to a fifth aspect of the invention, there is provided a method of perforating a wellbore in a hydraulic fracturing operation, the method comprising:

providing a perforating gun assembly comprising a charge carrier having a longitudinal axis; a first group of shaped charges comprising at least two shaped charges arranged to generate jets oriented substantially along respective axes that converge towards one another in a first convergence plane;

a second group of shaped charges comprising at least two shaped charges arranged to generate jets oriented substantially along respective axes that converge towards one another in a second convergence plane;

wherein in at least one of the groups of shaped charges, a convergence angle between the orientation direction of two shaped charges within the group is selected to locate its focal point at a position which is axially offset from an axial midpoint between the outermost charges in the group;

locating the perforating gun assembly in a wellbore at a perforation location;

detonating the first and second groups of charges to form first and second perforation channels, having defined first and second fracture initiation points respectively;

wherein at least one of the defined first and second fracture initiation points is located at a position which is axially offset from an axial midpoint between the outermost shaped charges in its respective group.

At least one of the defined first and second fracture initiation points may be located on or close to a principal fracturing plane.

Embodiments of the fifth aspect of the invention may include one or more features of the first to fourth aspects of the invention or their embodiments, or vice versa.

According to a sixth aspect of the invention, there is provided a method of perforating and fracturing a cased or lined wellbore, the method comprising:

carrying out the method of the fifth aspect of the invention; pumping a fracturing fluid into the wellbore to the perforation location and into the perforation channels; and initiating and propagating a fracture from the defined first and second fracture initiation points.

Embodiments of the sixth aspect of the invention may include one or more features of the first to fourth aspects of the invention or their embodiments, or vice versa.

According to a further aspect of the invention, there is provided a perforating gun assembly substantially as described herein with reference to FIGS. 1A, 1B, 2A and 2B of the drawings.

According to a further aspect of the invention, there is provided a perforating gun assembly substantially as described herein with reference to FIGS. 4A and 4B of the drawings.

According to a further aspect of the invention, there is provided a method of performing a hydraulic fracturing operation substantially as described herein with reference to FIGS. 1 to 3D of the drawings.

According to a further aspect of the invention, there is provided a method of performing a hydraulic fracturing operation substantially as described herein with reference to FIGS. 6A to 6C of the drawings.

According to further aspects of the invention, there are provided methods of performing a hydraulic fracturing operation substantially as described herein with reference to any of FIGS. 8 to 13 of the drawings.

BRIEF DESCRIPTION OF THE DRAWINGS

There will now be described, by way of example only, a various embodiments of the invention with reference to the drawings, of which.

DETAILED DESCRIPTION OF PREFERRED EMBODIMENTS

Figure 1A:
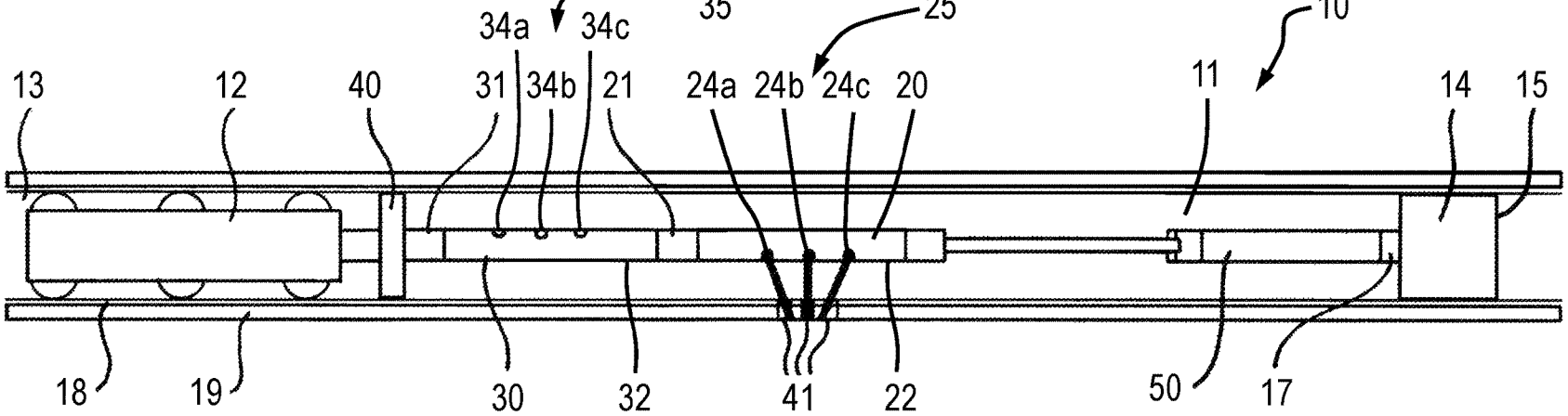
FIG. 1A is a schematic sectional view of a perforating gun assembly in accordance with a first embodiment of the invention in an initial detonation position.
Figure 1B:
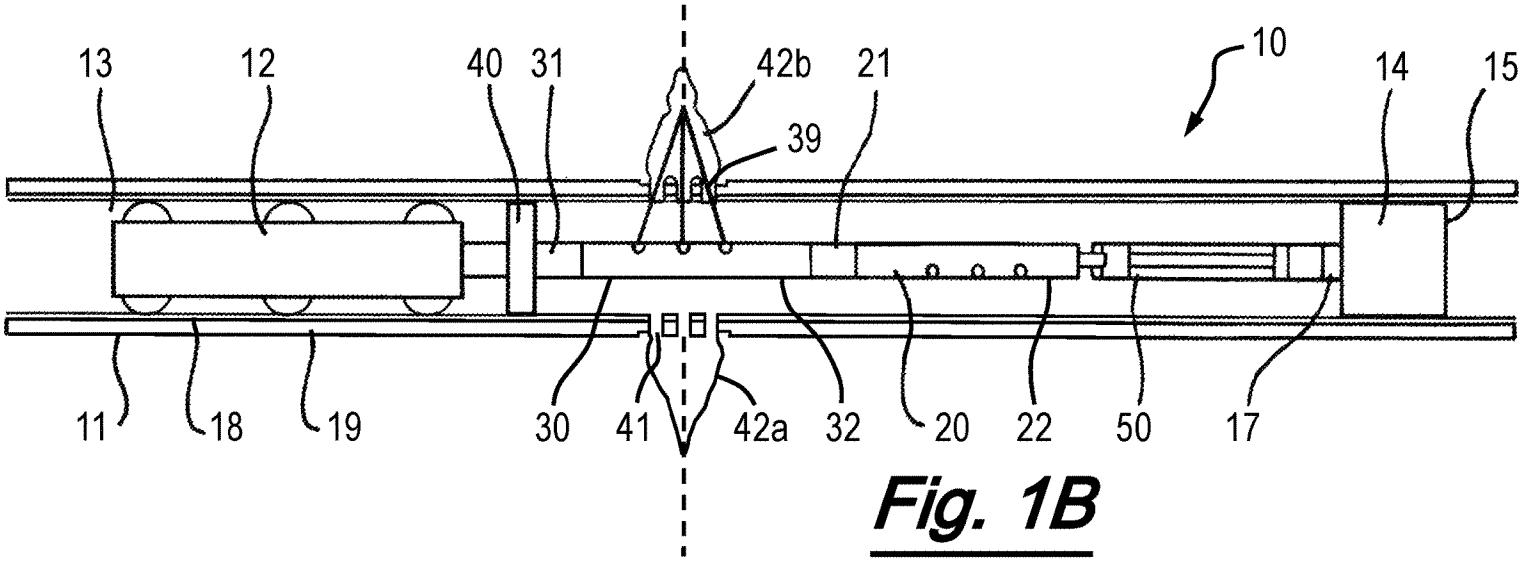
FIG. 1B is a schematic sectional view of the perforating gun assembly of FIG. 1A in a second detonation position.

Referring firstly to FIGS. 1A and 1B, there is shown schematically a perforating gun assembly, generally depicted at 10, located in a cased wellbore 11. FIG. 1A shows the assembly 10 in an initial detonation position, and FIG. 1B shows the perforating gun assembly of FIG. 1A in a second detonation position, as will be described below. It is an aim of the invention to provide a perforating gun assembly for hydraulic fracturing applications, and the following embodiments of the invention will be described in that context. However, the invention has application to alternative reservoir treatment operations, and its benefits may also arise where the invention is applied to injection of other fluids, such as in water and or gas flood operations, in which breakdown (fracturing) of the formation is often (but not necessarily) a consequence of such operations.

The assembly 10 is designed to be deployed on a wireline or other flexible conveyance (not shown) with the assistance of a wireline tractor 12 located at the upper end 13 of the assembly. A lower packer 14 is provided at the lower end 15 of the assembly 10. A packer setting tool 17 connects the packer 14 to the assembly, enabling the packer 14 to anchor the assembly 10 against the casing 18 at its required depth and provide a fluid barrier in the wellbore at the lower end of the assembly.

The assembly comprises a first lower gun module 20, axially separated from the lower end 15 of the assembly, and a second, upper gun module 30, located between the lower gun module 20 and the upper end 13 of the assembly. A first detonator module 21 is associated with the lower gun module 20, and a second detonator 31 is associated with the upper gun module 30. The first and second detonation modules 21, 31 are controlled from surface and are independently switchable to detonate the first and second gun modules respectively. A centraliser device 40 provides centralisation and support for the assembly, and in this example is located between the upper gun module 30 and the wireline tractor 12.

A positioning and alignment module 50 connects the packer 14 to the lower gun module 20 via the packer setting tool 17. The positioning and alignment module 50, which will be described in more detail below, functions to enable translation of the assembly between defined first and second detonation positions shown in FIGS. 1A and 1B respectively.

Each of the lower and upper gun modules 20, 30 comprises a housing 22, 32 which forms a casing for the internal components of the gun module. Each housing is a substantially cylindrical hollow tube, with an internal bore sized to receive and accommodate a charge carrier. The charge carrier functions to support a number of shaped charges 24*a*, 24*b*, 24*c*, 34*a*, 34*b*, and 34*c* (together 24 and 34 respectively). The shaped charges are ballistic elements as are known in the field of wellbore perforation and hydraulic fracturing. Each includes a housing, a liner, and a quantity of explosives between the housing and the liner. On detonation the shaped charges generate a high pressure stream of particles referred to as a jet. The jet direction depends on the orientation of the shaped charge within the gun assembly.

The charge carriers of this embodiment are substantially cylindrical hollow tubes of unitary construction which extend over an axial length of the gun assembly. Arranged over its length are a number of apertures, which extend from the outer wall of the charge carrier to a bore defined by the charge carrier. Each aperture is sized and shaped to receive a shaped charge in its desired orientation. Corresponding mounting holes are located diametrically opposite the apertures and provide a fixing point for the shaped charge in its desired orientation. The apertures and holes enable the shaped charge to be mounted at a fixed angle with respect to a plane perpendicular to the longitudinal axis L of the charge carrier. The orientation of the apertures and the mounting holes together determines the orientation of the shaped charges, and consequently the direction of jets resulting from the detonation of the shaped charges and the nature of the perforations formed.

The shaped charges 24, 34 are configured to form a hole in the casing 18 and cement lining 19. It will be appreciated that charges of different weights may be used in the first and/or second gun modules, and the invention is not restricted to configurations which have equal charge weights in the first and second sets of charges.

The shaped charges of each gun module 20, 30 are arranged in functional groups of converging charges. In upper module 30, a group of shaped charges 35 comprises shaped charges 34*a*, 34*b* and 34*c*, all of which are oriented in a line parallel to the longitudinal axis such that they are in the same plane parallel to the longitudinal axis (which may be referred to as a convergence plane). Two of the charges, 34*a* and 34*c*, are oriented with their axes at angles inclined to a plane which is perpendicular to the longitudinal axis of the charge carrier such that they converge towards one another. In addition, the axis of charge 34*b* is oriented towards the point of intersection of the axes of charges 34*a* and 34*c*. The three shaped charges in the group are therefore oriented to converge to the same focal point in the formation.

In the first (lower) gun module 20, the large hole shaped charges 24*a,b,c* are also arranged in a functional group of converging charges, with orientation axes corresponding to the axes of the group of shaped charges 35, but rotationally offset, in this case by 180 degrees. The group of shaped charges 25 consists of shaped charges 24*a*, 24*b* and 24*c*.

The perforating gun assembly 10 also contains a detonation system which in this case comprises a pair of detonation modules 21, 31 and corresponding detonation cords (not shown) which run along the length of the bore of the charge carrier, connecting the shaped charges of their respective modules in series. Each detonation module 21, 31 is independently controllable from surface to detonate the respective gun modules. Other detonation arrangements, such as those that use different detonation sequences or timing delays, may be used in alternative embodiments and are within the scope of the invention.

Figure 2B:
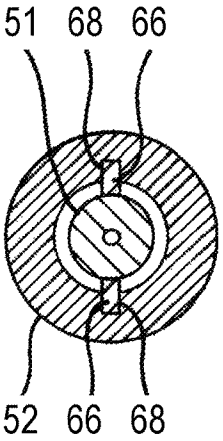
FIG. 2B is a schematic sectional view of an alignment mechanism of the positioning and alignment module of the gun assembly of FIG. 2A.
Figure 2A:
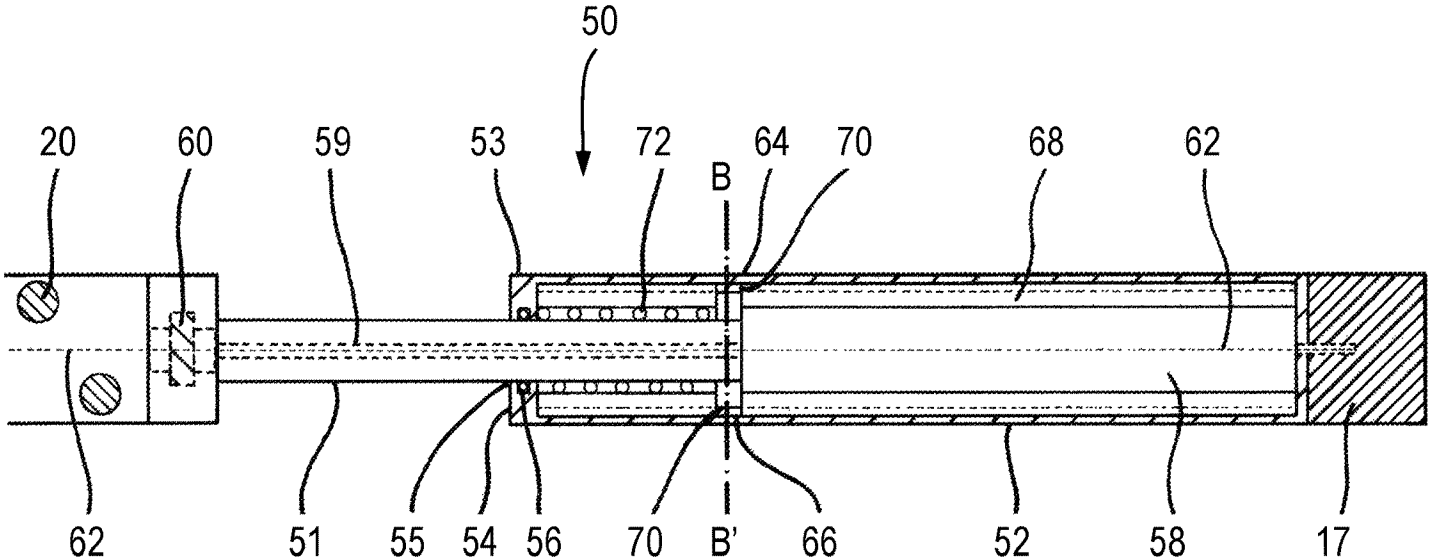
FIG. 2A is a schematic sectional view of the positioning and alignment module of the gun assembly of FIG. 1A, showing internal components.

FIGS. 2A and 2B show schematically details of the positioning and alignment module 50 of the assembly 10, suitable for use with an assembly which is deployed using a motive force, such as a wireline tractor, coiled tubing, or drill pipe. FIG. 2A shows the tool 50 in longitudinal section, and FIG. 2B is a cross section through line B-B[1]. The tool 50 is located between the lower gun module 20 and the packer setting tool 17, and is shown in FIG. 2A in a closed position. The tool comprises a guide shaft 51 extending from the lower gun module 20 into a tubular guide body 52 connected to the lower end of the assembly. An upper end 53 of the guide body 52 has an end plate 54, with an aperture 55 for receiving the guide shaft 51. A sealing ring 56 seals the end plate 54 against the guide shaft 51.

The guide body 52 defines a closed chamber 58 which is filled with a fluid. A bore 59 extending through the guide shaft 51 provides fluid communication to the lower gun module 20, which prior to operation, is sealed by a ported rupture disc sub assembly 60. The bore 59 also accommodates an electrical control line 62 which passes through the chamber 58 to connect the packer setting tool 17 to surface.

At a lower end 64 of the guide shaft 51 is a pair of guide keys 66. The guide keys 66 extend radially outward of the guide shaft 51 into keyways 68 of the guide body 52. The guide shaft is therefore able to slide within the guide body in use, but is rotationally keyed with respect to the guide body. The guide keys 66 are initially secured in the keyways by shear pins 70, preventing movement of the assembly prior to actuation. A power spring 72 is disposed between the end plate 54 and a shoulder located adjacent the guide keys.

A method of use of an embodiment of the invention will now be described with reference to FIGS. 1A, 1B, 2A, 2B, and 3A to 3D.

Figure 3D:
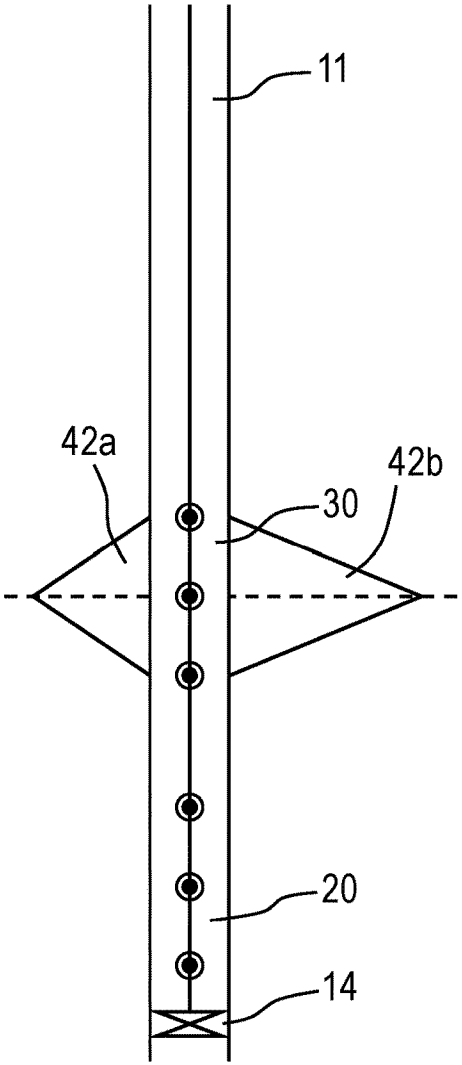
FIGS. 3A to 3D are schematic representations of sequential steps of a perforating method using the perforating gun assembly of FIGS. 1 and 2 in accordance with an embodiment of the invention.
Figure 3C:
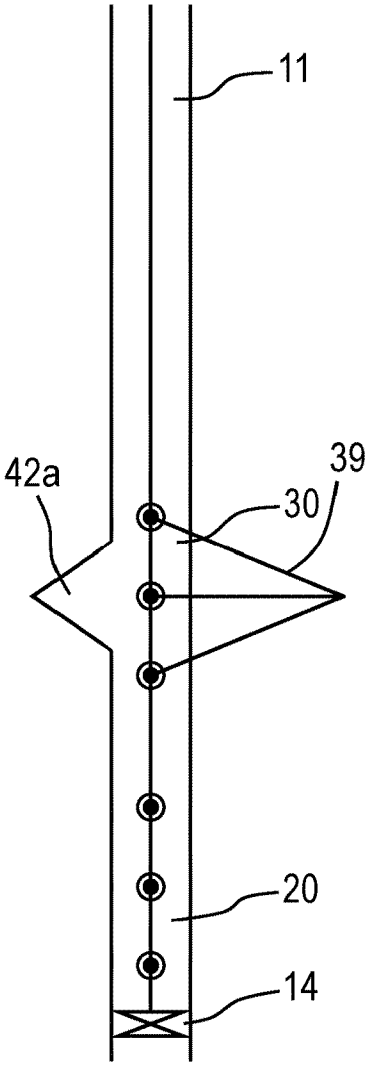
Figure 3B:
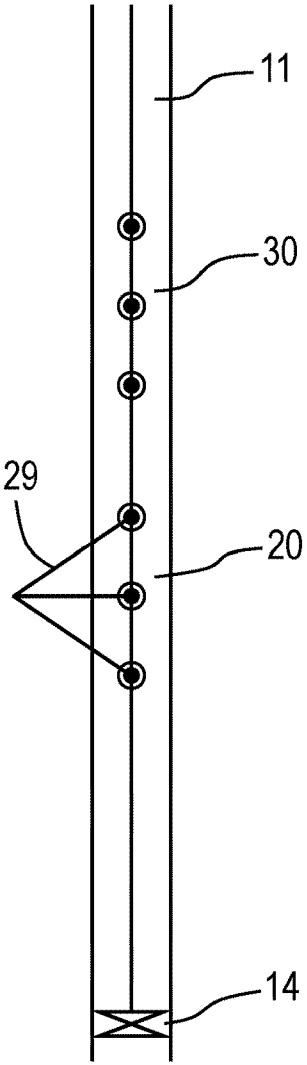
Figure 3A:
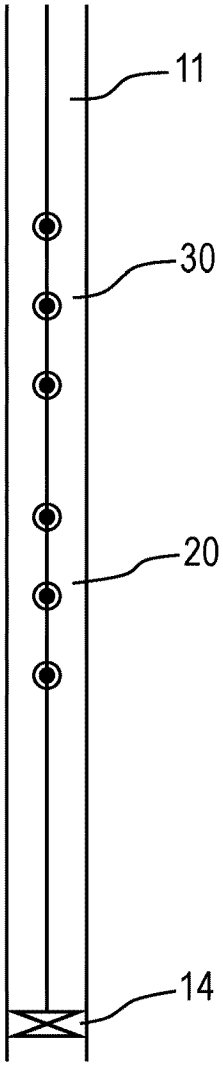

Referring firstly to FIGS. 1A and 3A, the assembly 10 is deployed on an electric wireline or other flexible conveyance to its required depth in the cased wellbore. When located in the required position, the packer setting tool 17 is actuated via the electrical control line 62 to set the packer 14 and anchor the assembly against the casing 18.

With the packer set, the lower gun module 20 is ready to be detonated. The shear pins 70 are intact and retain the positioning and alignment module in its spaced-out position, as shown in FIG. 1A. In addition, the fluid chamber 58 remains closed and pressure isolated. The chamber 58 and bore 59 define a fixed fluid volume to the rupture disc sub assembly 60, preventing downward movement of the guide shaft 51 and other components of the assembly.

The charges of the gun module 20 are detonated, jets 29 from the shaped charges 24 result in the formation of perforation channel 42*a* which penetrates the casing 18 and cement 19 to connect the wellbore with the formation immediately outside of the wellbore (FIG. 3B). The convergent charges of the assembly form a perforation channel 42*a* which is substantially triangular in section and has a defined fracture initiation point at the apex of the channel.

During detonation of the first gun module 20, the pressure and forces generated from the explosion event are sufficient to break the rupture disc in the sub assembly 60, enabling pressure communication between ports (not shown) in the sub assembly 60 and the chamber 58.

The wireline tractor 12 is engaged to provide a downward motive force on the assembly 10, which is transferred through the guide shaft 51 to the guide keys 66 to shear the pins 70. The guide shaft 51 is released from the guide body 52 and the downward motive force from the wireline tractor 12 causes the shaft 51 to move downwards in the guide body. Movement is assisted by the power spring 72. As the shaft 51 moves downwards, fluid from the chamber 58 exits through the bore 59 and the ports (not shown) in the rupture disc sub assembly 60.

The shaft 51 is only permitted to move with respect to the guide body and packer by a fixed predetermined distance, which is selected to position the shaped charges of the second (upper) gun module 30 directly over the casing entry holes 41 formed by the first detonation, as shown in FIG. 1B. A consequence of the assembly being anchored to the packer 14 at the lower end of the assembly is that the operation is executed from a fixed depth reference. Throughout travel of the assembly to its lower position, rotation of the assembly is prevented by the arrangement of guide keys and keyways.

With the assembly 10 in the second, lower position as shown in FIG. 1B, FIG. 3C and FIG. 3D, the second gun module 30 is ready to be detonated. Optionally, a latch mechanism (not shown) is provided to lock the guide shaft into its lower position, so that when the assembly is recovered to surface, it can be inspected to ensure that the components were properly translated to their required positions before the second detonation. Detonation module 31 is fired to detonate the charges 34 of the second module. The charges are oriented such that they create jets 39 which form perforation channels 42*b* adjacent the wellbore, at an azimuthal position which is rotationally offset from the channel 42*a* (in this case by 180 degrees). The convergent charges of the assembly form a perforation channel 42*b* which is substantially triangular in section and has a defined fracture initiation point at the apex of the channel.

The described embodiment of the invention enables placement of the second perforation channel 42*b* at an axial position of the wellbore such that it overlaps with the channel 42*a*, as shown in FIG. 3D. This enables the apex of the channel 42*b*, which is a fracture initiation point for a hydraulic fracturing operation, to be placed at a desired axial position with respect to the fracture initiation point of the channel 42*a*. In this embodiment, the respective fracture initiation points are located at the same axial position, in the principal fracture plane of the formation. When hydraulic fluid is pumped into the channels 42*a*, 42*b*, it is directed towards the apexes of the channels. The placement of both apexes in the principal fracture plane facilitates single planar fracture growth.

In this embodiment, the preferred fracture direction is the direction of maximum horizontal stress, and the wellbore is drilled predominantly in the direction of minimum horizontal stress. The apexes of the channels, are the convergent points for delivery of fracturing fluid, and are aligned in a single plane which is substantially aligned with the preferred fracture direction (the direction of maximum horizontal stress). This arrangement promotes fracture initiation from the wellbore which cross cuts both perforation channels, in the preferred orientation. The perforation interval has been limited to a very short section, which reduces a tendency for fracture tortuosity and multiple fracture events, and facilitates Limited Entry.

With conventional perforation assemblies and methods, placement of a pair of fracture initiation points in the same fracture plane is limited by the geometry and size of the perforation assembly. Where convergent charge groups are used, restrictions on shaped charge placement and phasing may prevent placement of two groups of charges, oriented in distinct convergence planes, over the same axial position of the assembly. The described embodiment addresses this issue by forming the perforation channels, and fracture initiation points, during two detonation and perforation events, separated by an axial shift in gun assembly position.

It will be appreciated that in a variation to the above-described embodiment of the invention, a second perforation channel may be formed with its apex at a position close to, but not necessarily at the same axial point of the apex of the first. The principles of the system may be applied to place the second perforation and its apex at a desired axial position with respect to the first. This may be the same axial position, an axial position close to the first, or an axial position at a desired separation. In the latter case, it may be desirable in some formations and/or wellbore orientations to place respective apexes separated by a distance which places them in alignment with and/or on a principal fracture plane which is not perpendicular to the wellbore. It may be desirable in some formations and/or wellbore orientations, to place respective apexes separated by a distance which places them at a desired angle to a principal fracture plane which is not perpendicular to the wellbore.

Although the above-described embodiment has the two groups of shaped charges arranged in opposed orientations, such that their rotational offset is 180 degrees, other azimuthal angles of separation are within the scope of the invention. Indeed, the respective groups of shaped charges may be phased at any desired angle, without being limited by gun carrier geometry or size. For example, the convergence plane of a second group of charges may be rotationally offset by 45 degrees, 60 degrees, 90 degrees, 120 degrees, or any angle suited to the formation or wellbore geometry. Apexes of the second created perforations may be placed at the same axial position, an axial position close to the first, or an axial position at a desired separation from the first as described above.

Figure 4B:
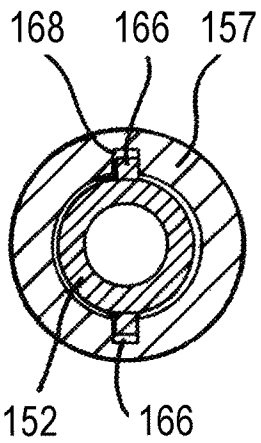
FIG. 4B is a schematic sectional view of an alignment mechanism of the positioning and alignment module of the gun assembly of FIG. 4A.
Figure 4A:
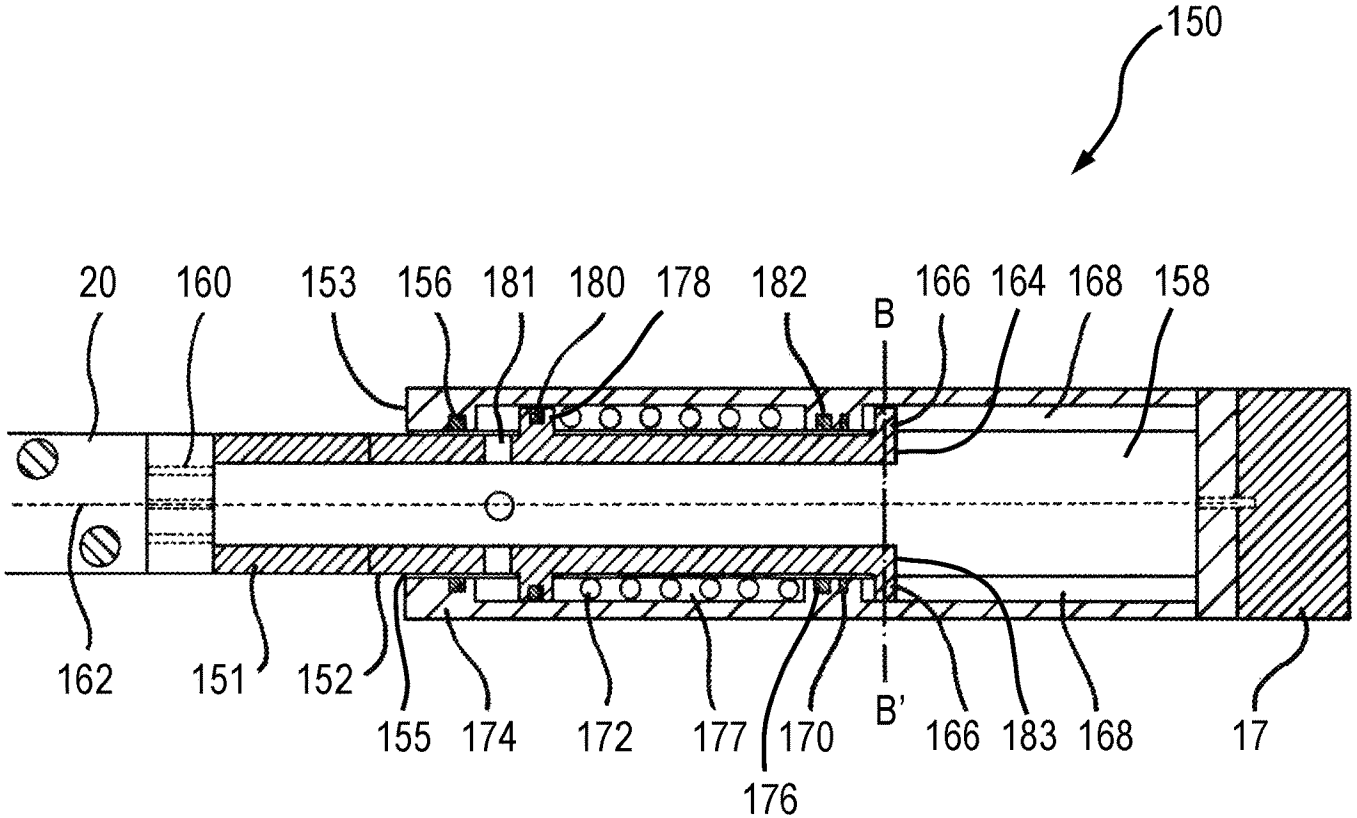
FIG. 4A is a schematic sectional view of a positioning and alignment module of a gun assembly according to an alternative embodiment of the invention, showing internal components.

The above-described embodiment of the invention comprises a positioning and alignment module 50 suitable for use with an assembly which is deployed using a motive force, such as a wireline tractor, coiled tubing, or drill pipe. However, the principles of the invention are also applicable where there is no motive force available, and FIGS. 4A and 4B are schematic views of a positioning and alignment module 150 of a perforating gun assembly according to an alternative embodiment of the invention. FIG. 4A shows the module 150 in longitudinal section, and FIG. 4B is a cross section through line B-B'. The module, generally depicted at 150, is similar to module 50 of FIGS. 1A, 1B, 2A, and 2B and its principles of operation will be understood from those Figures and their accompanying description. However, the assembly 150 differs in several respects which will be described below.

The module 150 is located between the lower gun module 20 and the packer setting tool 17, and is shown in FIG. 4A in a closed position. The tool comprises a spacer shaft 151 extending from the lower gun module 20 and connecting to a tubular inner piston mandrel 152 connected to the lower end of the assembly. The inner piston mandrel 152 extends into an outer piston mandrel 157. An upper end 153 of the outer piston mandrel 157 has an opening 155 for receiving the inner piston mandrel 152. A sealing ring 156 seals the outer mandrel against the inner mandrel.

The outer piston mandrel 157 defines a closed chamber 158 which is fluidly connected with the internal volume of the lower gun module 20 via a ported sub assembly 160, and is filled with air at atmospheric pressure and isolated from well pressure. A pathway extending through the module provides a pathway for an electrical control line 162 which passes through the chamber 158 to connect the packer setting tool 17 to surface.

At a lower end 164 of the inner piston mandrel 152 is a pair of guide keys 166 in the form of lugs extending radially outward of the inner piston mandrel 152 into keyways 168 provided in the outer piston mandrel 157. The inner piston mandrel 152 is therefore able to slide within the outer piston mandrel 157 in use, but is rotationally keyed with respect to the outer piston mandrel 157. The mandrels 152, 157 are initially secured to one another by shear pins 170, preventing movement of the assembly prior to actuation.

The outer piston mandrel 157 comprises reduced inner diameter portions 174, 176 located at the upper end 153 and an axially separated position towards the lower end. The reduced inner diameter portions define an annular piston chamber 177 between the inner and outer piston mandrels. A piston flange 178 upstands from the inner piston mandrel 152 and carries an o-ring seal 180 to seal with the inner surface of the outer piston mandrel 157. A damping spring 172 is disposed between the piston flange 178 and a shoulder defined by the reduced inner diameter portion 176. An o-ring seal 182 seals the inner piston mandrel 152 against the reduced inner diameter portion 176. Pressure entry ports 181 connect the inside of the inner piston mandrel 152 with the piston chamber 177.

In use, a perforating gun assembly comprising the positioning and alignment module 150 will be operated in a similar manner to the assembly 10, and will be understood from the description of FIGS. 1A, 1B, 2A, and 2B. The assembly is deployed on an electric wireline or other flexible conveyance to its required depth in the cased wellbore. When located in the required position, the packer setting tool 17 is actuated via the electrical control line 162 to set the packer 14 and anchor the assembly against the casing 18. With the packer set, the lower gun module 20 is ready to be detonated. The shear pins 170 are intact and retain the positioning and alignment module in its spaced-out position, as shown in FIG. 4A. In addition, the chamber 158 remains closed and pressure isolated from the wellbore.

The charges of the gun module 20 are detonated, resulting in the formation of perforations which penetrate the casing 18 and cement to connect the wellbore with the formation immediately outside of the wellbore. After detonation of the first gun module 20, the internal volume of the gun module is exposed to well pressure, and wellbore fluids enter the gun module and pass through the ported sub assembly 160 to the inside of the inner piston mandrel 152. Well fluids flow under well pressure through the pressure ports 181 and into the piston chamber 177, and flow into the chamber until the volume is filled. The force from the well fluids acts on the relatively large face of the piston flange 178 and exceeds the force on the relatively small lower end 183 of the inner piston mandrel 152. The net force overcomes the rating of the shear pins 170 and pushes the inner piston mandrel 152 and upper assembly downwards in the outer piston mandrel 157. Movement is damped by the spring 172.

As with the previous embodiment, the upper assembly is only permitted to move with respect to the outer piston mandrel 157 and packer 14 by a fixed predetermined distance, which is selected to position the shaped charges of the second (upper) gun module 30 in the desired axial position with respect to the perforation channels formed by the first detonation, in the manner shown in FIG. 1B. With the assembly 10 in the second, lower position as shown in FIG. 1B, the second gun module 30 is ready to be detonated.

Further alternatives to the described embodiments are envisaged within the scope of the invention. In one variation, the principle of creating multiple perforations which overlap axially, but which are at distinct azimuthal angles, is combined with a perforating gun assembly and method which uses combinations of large hole and deep-penetrating charges to create each perforation channel. For example, a first gun module may comprise at least one large hole shaped charge, and a second gun module may comprise at least two deep penetrating shaped charges arranged to generate jets oriented substantially along respective axes that converge towards one another. The method may comprise locating the perforating gun assembly in a cased or lined wellbore with the first gun module adjacent a casing or liner at a perforation location and detonating the large hole shaped charges of the first gun module to form one or more large holes in the casing or liner. The perforating gun assembly may be translated in the wellbore to locate the second gun module adjacent the casing or liner at the perforation location such that the position of the deep penetrating shaped charges corresponds to the position of the one or more large holes; and the deep penetrating shaped charges of the second gun module are detonated to generate jets which pass through the one or more large holes and form at least two deep penetration holes in the formation adjacent the perforation location. The at least two deep penetration holes intersect to provide a connected channel in the formation.

The large hole area reduces the risk of early screen out of sand, which may bridge smaller entry holes, and reduces the axial extent over which the entry holes need to be formed, shortening the perforation interval and enhancing fracture placement. Advantageously, the single fracture initiation site may be located beyond the damaged zone and hoop stress affected region of the formation. By utilising a two-stage detonation process for each perforation channel, it is possible to use convergent shaped charge groups oriented to intersect at a point relatively deep into the formation.

The described method and apparatus assists in achieving a Limited Entry fracturing effect. Limited Entry fracturing is desirable as, by design, each perforation is in hydraulic communication and contributes fluid during the fracturing treatment, and therefore offers improved control over the initiation and growth of a fracture from within a given perforation network. Limiting the perforation interval to a very short section (for example as low as 1 ft to 2 ft or 0.3 m to 0.6 m) can have benefits towards reducing the fracture tortuosity and multiple fracture events, and facilitating Limited Entry fracturing, particularly in high angle or horizontal wells.

Shifting of the gun between axial positions may therefore be used (a) to place additional perforations in an already-perforated zone, with a fracture initiation point at desired axial and azimuthal spacing from a previously formed perforation channel, and (b) to align a second set of charges with previously formed large casing entry holes, to create deep penetrating channels through the large casing entry holes.

Figure 5:
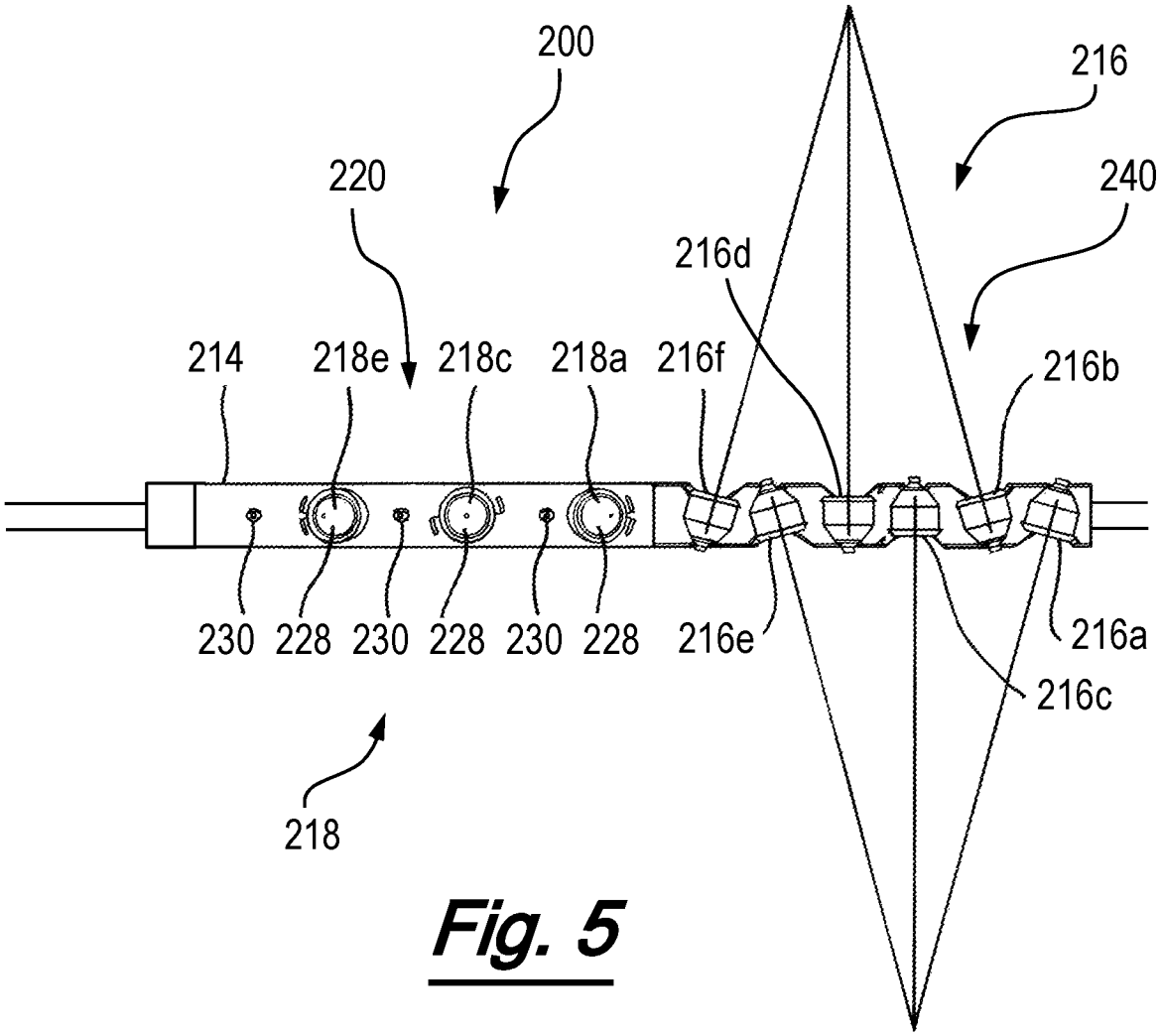
FIG. 5 is a part-sectional view of a charge carrier of a perforating gun assembly according to an alternative embodiment of the invention.

The above-described embodiments comprise distinct groups of convergent shaped charges. An alternative embodiment of the invention is illustrated in FIG. 5, which shows a charge carrier 200 comprising first and second gun modules 220, 240. The charge carrier 200 is a substantially cylindrical hollow tube of unitary construction which extends over an axial length of the gun assembly. Arranged over its length are a number of apertures 228, which extend from the outer wall of the charge carrier to a bore defined by the charge carrier. Each aperture 228 is sized and shaped to receive a shaped charge in its desired orientation. Corresponding mounting holes 230 are located diametrically opposite the apertures 228 and provide a fixing point for the shaped charge in its desired orientation.

In this embodiment, the apertures 228 and holes 230 are laser cut holes formed in the wall of the charge carrier. The aperture 228 and its corresponding mounting hole enable the shaped charge to be mounted at a fixed angle with respect to a plane perpendicular to the longitudinal axis of the charge carrier. The orientation of the apertures and the mounting holes together determines the orientation of the shaped charges, and consequently the direction of jets resulting from the detonation of the shaped charges and the nature of the perforations formed.

The shaped charges of the gun assembly are arranged in collections 216 and 218. Each collection comprises multiple charges and extends over an axial length of the charge carrier, and the collections 216, 218 are axially separated on the charge carrier. Within each collection, the shaped charges are arranged in functional groups of converging charges. In collection 216, a first group of shaped charges comprises shaped charge 216*a*, 216*c* and 216*e*, all of which are oriented in a line parallel to the longitudinal axis such that they are in the same plane parallel to the longitudinal axis. Two of the charges, 216*a* and 216*e*, are oriented with their axes at angles inclined to a plane which is perpendicular to the longitudinal axis of the charge carrier such that they converge towards one another. In addition, the axis of charge 216*c* is oriented towards the point of intersection of the axes of charges 216*a* and 216*e*. The three shaped charges in the group are therefore oriented to converge to the same point in the formation.

A second group of shaped charges is formed from charges 216*b*, 216*d*, and 216*f* all of which are oriented in a line parallel to the longitudinal axis such that they are in a plane parallel to the longitudinal axis. The plane of the second group is rotationally offset or phased with respect to the first group. In this case the phasing angle is 180 degrees, so that the first and second groups are oriented in the same plane but in opposing directions. Charges 216*b* and 216*f* are oriented with their axes at angles inclined to a plane which is perpendicular to the longitudinal axis of the charge carrier such that they converge towards one another. In addition, the axis of charge 216*d* is oriented towards the point of intersection of the axes of charges 216*a* and 216*e*. The three shaped charges in the second group are therefore oriented to converge to the same point in the formation.

The first and second groups of charges are intermeshed or interlaced such that they overlap over the axial direction of the charge carrier; each group extends over an axial portion which overlaps a perpendicular plane. This configuration of converging charge groups has surprising advantages relating to gun survival and flow geometry.

Collection of charges 218 comprises two groups of convergent shaped charges (218*a*, 218*c*, 218*e* and 218*b*, 218*d*, 218*f* (not shown)) which are intermeshed or interlaced such that they overlap over the axial direction of the charge carrier. The two groups are phased by an angle 180 degrees. In addition, collection 218 is rotationally offset or phased with respect to the collection 216, in this case by an angle of 90 degrees.

The shaped charges, arranged in functional groups in the charge carrier as described above, are loaded into the perforating gun assembly by locating and securing the charge carrier 200 into the housing 214. The housing 214 also comprises scallops distributed over the surface of the housing in locations which correspond to the positions and orientations of the shaped charges in the assembled gun.

Figure 6C:
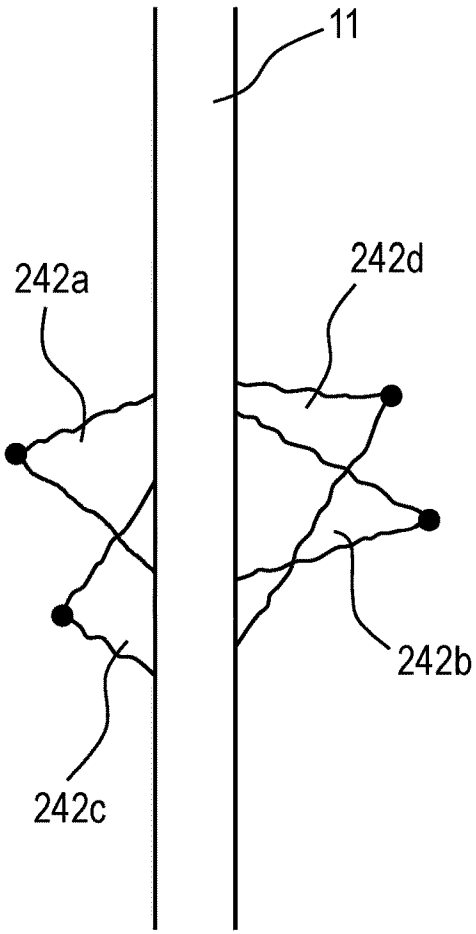
FIGS. 6A to 6C are schematic representations of sequential steps of a perforating method using the perforating gun assembly of FIG. 5, in accordance with an embodiment of the invention.

A method of use of an embodiment of the invention will now be described with additional reference to FIGS. 6A to 6C. Referring firstly to FIGS. 5 and 6A, the assembly is deployed on an electric wireline or other flexible conveyance to its required depth in the cased wellbore. When located in the required position, the packer setting tool 17 is actuated via the electrical control line 62 to set the packer 14 and anchor the assembly against the casing 18.

With the packer set, the lower gun module 220, consisting of a two groups of convergent charges intermeshed with one another, is detonated. Jets 229*a*, 229*b* from the shaped charges create perforation channels 242*a* and 242*b* which penetrate the casing 18 and cement 19 to connect the wellbore with the formation immediately outside of the wellbore (FIG. 6B). The perforation channels 242*a*, 242*b* are substantially triangular in section with apexes defining fracture initiation points which are closely spaced to one another due to the intermeshed arrangement of charge groups.

Figure 6B:
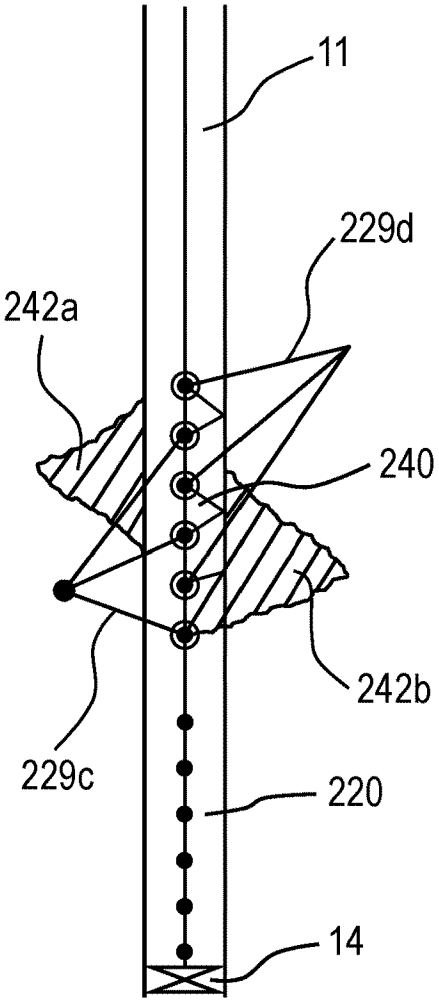
Figure 6A:
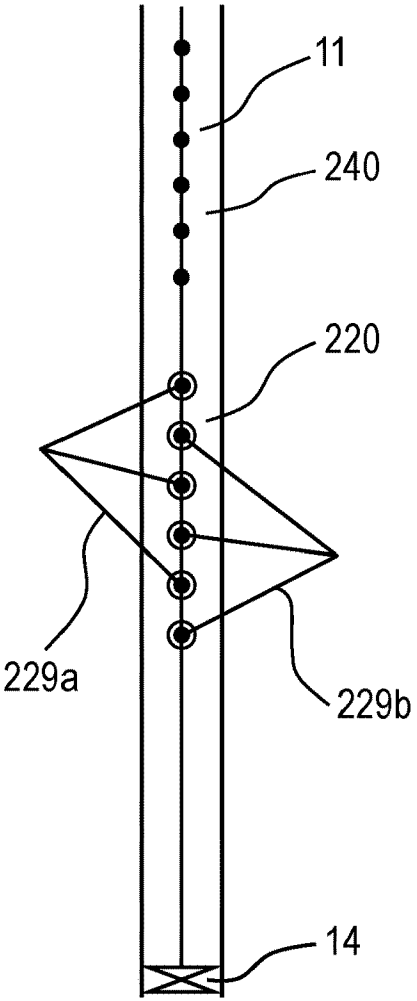

The wireline tractor 12 is engaged to provide a downward motive force on the assembly, to position the shaped charges of the second (upper) gun module 240 in the wellbore in an axial region which overlaps with an axial region of the perforations 242*a*, 242*b* formed by the first detonation, as shown in FIG. 6B. Throughout travel of the assembly to its lower position, rotation of the assembly is prevented by the arrangement of guide keys and keyways.

With the assembly 10 in the second, lower position as shown in FIG. 6B, the second gun module 240 is ready to be detonated. The charges are oriented such that they create jets 229*c*, 229*d* which form perforation channels 242*c*, 242*d* (FIG. 6C) adjacent the wellbore, at an azimuthal position which is rotationally offset from the channels 242*a*, 242*b* (in this case by 90 degrees). The perforation channels 242*c*, 242*d* are substantially triangular in section and have defined fracture initiation points at the apex of the channels, closely spaced to one another. The resulting perforation pattern places four fracture initiation points on or close to a single fracture plane of the formation. The placement of all four apexes in or close to the principal fracture plane facilitates single planar fracture growth.

It will be appreciated that variations to the above-described embodiments are within the scope of the invention. For example, the steps of detonating a first group of charges, translating the gun assembly, and detonating a second group of charges can be repeated multiple times, so that multiple perforating channels can be created at desired axial positions, for example aligned with or close to a principal fracturing plane. Multiple perforation channels can be located close to one another with distinct azimuthal orientations without being limited by gun geometry. Alternatively, or in addition, each detonation event may detonate multiple groups of shaped charges which are axially displaced on the perforating gun assembly, so that multiple perforating channels are produced at axially displaced locations.

Variations to the methodology for translating the perforating gun assembly are also within the scope of the invention. For example, in simple embodiments of the invention, the perforating gun assembly may be run on a conveyance which is shifted upwards or downwards in the wellbore between detonations by pulling or lowering the conveyance from surface. This may simply be the pulling or lowering of a wireline, coiled tubing, or drill pipe by a specified distance to place a second group of charges in the desired location for the second (or subsequent) detonation step. Such a configuration may provide sufficiently precise placement in some perforating or fracturing applications.

Figure 7:
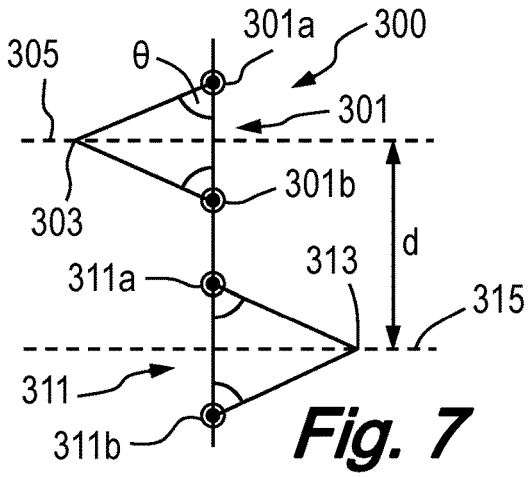
Fig. 7 (Prior Art)
FIG. 7 is a schematic representation of a prior art perforating geometry using two groups of convergent charges.

The above-described methods utilise convergent groups of charges to create perforation channels, the apexes of which are determined by the convergence angles of the shaped charges. FIG. 7 shows schematically the orientation of two groups of convergent shaped charges in a conventional arrangement 300, in which the two groups are rotationally offset or phased by 180 degrees. An upper group 301 of two charges 301*a*, 301*b* has symmetrical convergence angles towards an apex 303, and a lower group 311 of two charges 311*a*, 311*b* has symmetrical convergence angles towards an apex 313. The apex 303 is located at the midpoint between the charges 301*a*, 301*b*, at an axial point of the wellbore 305 and apex 313 is located at the midpoint between the charges 311*a*, 311*b*, at an axial point in the wellbore 315, separated from the point 305 by an axial distance d. This distance d may be acceptable in some formations and well geometries, but can be a limitation on placement of the fracture initiation points in the same fracture initiation plane for single plane fracture initiation. Similar (albeit significantly reduced) limitations apply in the case of the intermeshed or interlaced charge groups in the configuration of FIG. 5.

The present invention in one of its aspects overcomes limitations of perforating gun geometry and size by selecting convergence angles in at least one group of charges, so that the apex is axially offset from the midpoint of a group of charges, and is located at a desired axial point of the wellbore (in most cases axially closer to another perforation channel apex).

Figure 8:
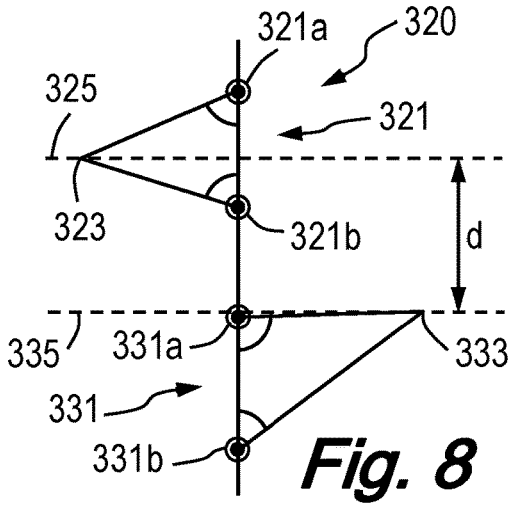
FIG. 8 is a schematic representation of a perforating orientation in accordance with an embodiment of the invention.
Figure 9:
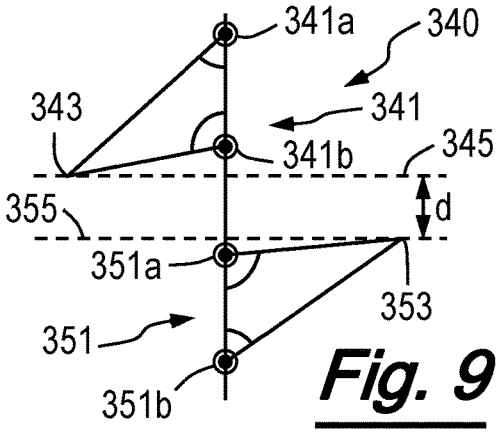
FIG. 9 is a schematic representation of a perforating orientation in accordance with an alternative embodiment of the invention.
Figure 10:
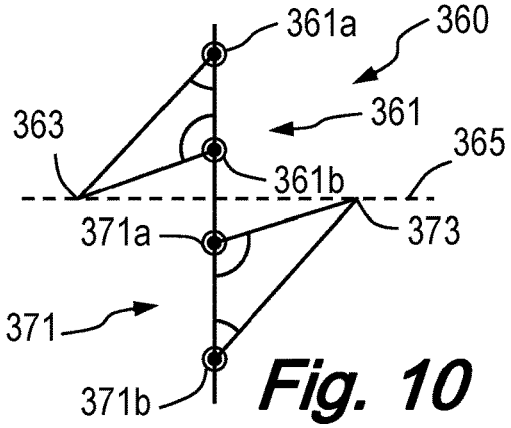
FIG. 10 is a schematic representation of a perforating orientation in accordance with an alternative embodiment of the invention.

FIGS. 8 to 10 are a schematic representations of perforation arrangements according to embodiments of the invention. In each case, the arrangement comprises two groups of charges rotationally offset or phased by 180 degrees.

In the arrangement 320 of FIG. 8, an upper group 321 of two charges 321*a*, 321*b* has symmetrical convergence angles towards an apex 323, and a lower group 331 of two charges 331*a*, 331*b* has asymmetrical convergence angles towards an apex 333. The interior angle of orientation of charge 331*a* is increased with respect to the interior angle of orientation of charge 331*b*, to shift the axial position 335 of the apex 333 upwards in the wellbore, towards the axial position 325 of the apex 323 of the upper group of charges. In this case the angle of charge 331*a* is approximately 90 degrees, and the angle of charge 331*b* is correspondingly reduced. The respective apexes 323, 333 are therefore more closely spaced than the conventional arrangement of FIG. 7, and may be placed in, or relatively close to, a single fracture plane of the formation.

In the arrangement 340 of FIG. 9, an upper group 341 of two charges 341*a*, 341*b* has asymmetrical convergence angles towards an apex 343, and a lower group 351 of two charges 351*a*, 351*b* has asymmetrical convergence angles towards an apex 353. The interior angle of orientation of charge 341*a* is reduced with respect to the interior angle of orientation of charge 341*b*, to shift the axial position 345 of the apex 343 downwards in the wellbore, towards the lower group of charges. The interior angle of orientation of charge 351*a* is increased with respect to the interior angle of orientation of charge 351*b*, to shift the axial position 355 of the apex 353 upwards in the wellbore, towards the axial position of the upper group of charges. The respective apexes 343, 353 are therefore more closely spaced than the conventional arrangement of FIG. 7, and may be placed in, or relatively close to, a single fracture plane of the formation.

In the arrangement 360 of FIG. 10, an upper group 361 of two charges 361*a*, 361*b* has asymmetrical convergence angles towards an apex 363, and a lower group 371 of two charges 371*a*, 371*b* has asymmetrical convergence angles towards an apex 373. The interior angle of orientation of charge 361*a* is reduced with respect to the interior angle of orientation of charge 361*b*, to shift the axial position 365 of the apex 363 downwards in the wellbore, towards the lower group of charges. In this case, the interior angle of the lowermost charge in the group 361 is obtuse, so that the axial position of the apex 363 is below the axial position of the lowermost charge. The interior angle of the uppermost charge in the group 371 is obtuse, so that the axial position of the apex 373 is above the axial position of the uppermost charge. The respective apexes 363, 373 are therefore more closely spaced than the conventional arrangement of FIG. 7, and more closely spaced than the respective charge groups 361, 371. In this embodiment, the apexes are located at the same axial position 365, in a single fracture plane of the formation, which is perpendicular to the wellbore orientation.

Although the selection of convergence angles for apex placement is advantageous for axially separated groups of convergent charges, as shown in FIGS. 8 to 10, similar benefits apply to groups of intermeshed charges of the type shown in FIG. 5. The arrangements of FIGS. 11 and 12 each relate to perforation systems having groups of three convergent charges in an intermeshed or interlaced arrangement.

Figure 11:
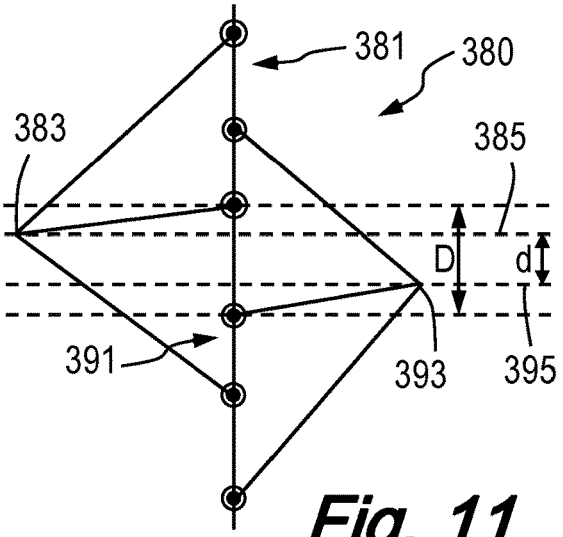
FIG. 11 is a schematic representation of a perforating geometry with two intermeshed groups of charges, in accordance with an embodiment of the invention.

In the arrangement 380 of FIG. 11, an upper group 381 of three charges has asymmetrical convergence angles towards an apex 383, and a lower group 391 of three charges has asymmetrical convergence angles towards an apex 393. In the upper group 381, the interior angle of orientation of the uppermost charge is reduced with respect to the interior angle of orientation of the lowermost charge, to shift the axial position 385 of the apex 383 downwards in the wellbore, towards the lower group of charges. The orientation angle of the centre charge is selected to be aligned with the apex 383. In the lower group 391, the interior angle of orientation of the lowermost charge is reduced with respect to the interior angle of orientation of the uppermost charge, to shift the axial position 395 of the apex 393 upwards in the wellbore, towards the upper group of charges. The orientation angle of the centre charge is selected to be aligned with the apex 393. Distance D is the natural separation of the apexes for a symmetrical convergent arrangement, and distance d is the separation with the selected angles of this embodiment of the invention. The respective apexes 383, 393 are therefore more closely spaced than a symmetrical arrangement, and may be aligned with, or close to, a principal fracture plane of the formation.

Figure 12:
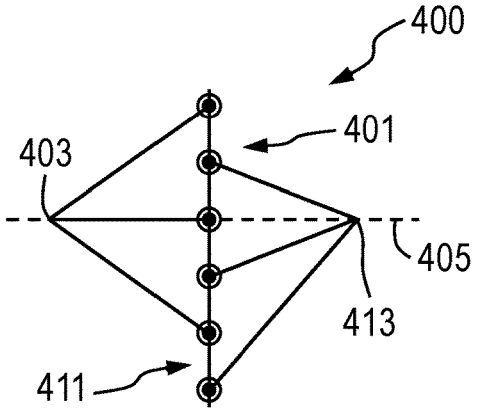
FIG. 12 is a schematic representation of a perforating geometry with two intermeshed groups of charges, in accordance with an alternative embodiment of the invention.

In the arrangement 400 of FIG. 12, an upper group 401 of three charges has symmetrical convergence angles towards an apex 403, and a lower group 411 of three charges has asymmetrical convergence angles towards an apex 413. In the lower group 411, the interior angle of orientation of the lowermost charge is reduced with respect to the interior angle of orientation of the uppermost charge, to shift the axial position 405 of the apex 413 upwards in the wellbore, away from the midpoint of the charge group and towards the upper group of charges. The orientation angle of the centre charge is selected to be aligned with the apex 413. In this embodiment, the apexes are located at the same axial position 405, in a single fracture plane of the formation, which is perpendicular to the wellbore orientation.

Although the above-described arrangements have the two groups of shaped charges arranged in opposed orientations, such that their rotational offset is 180 degrees, other azimuthal angles of separation are within the scope of the invention.

The selection of appropriate angles for desired placement of apexes and fracture initiation points as described with reference to FIGS. 7 to 12 may be applied in combination with the apparatus and methods of FIGS. 1 to 6, to provide a high degree of flexibility of fracture initiation point placement. Alternatively, or in addition, the described selection of angles may be implemented in a perforation system which uses a combination of large hole charges and deep penetrating charges, where the deep penetrating charges are detonated through casing entry holes formed by the large hole charges, in the manner described above. Such a method may be particularly advantageous where deep penetration into the formation is desirable to achieve convergence of charges at selected axial points, without high degrees of asymmetry between charge angles. For example, the desired axial shift of apexes and fracture initiation points may be achieved by relatively small changes to convergence angles, if the convergence point is an increased distance from the wellbore axis. The combination of large hole and deep penetrating hole charges may facilitate convergence at these increase penetration distances from the wellbore.

Figure 13:
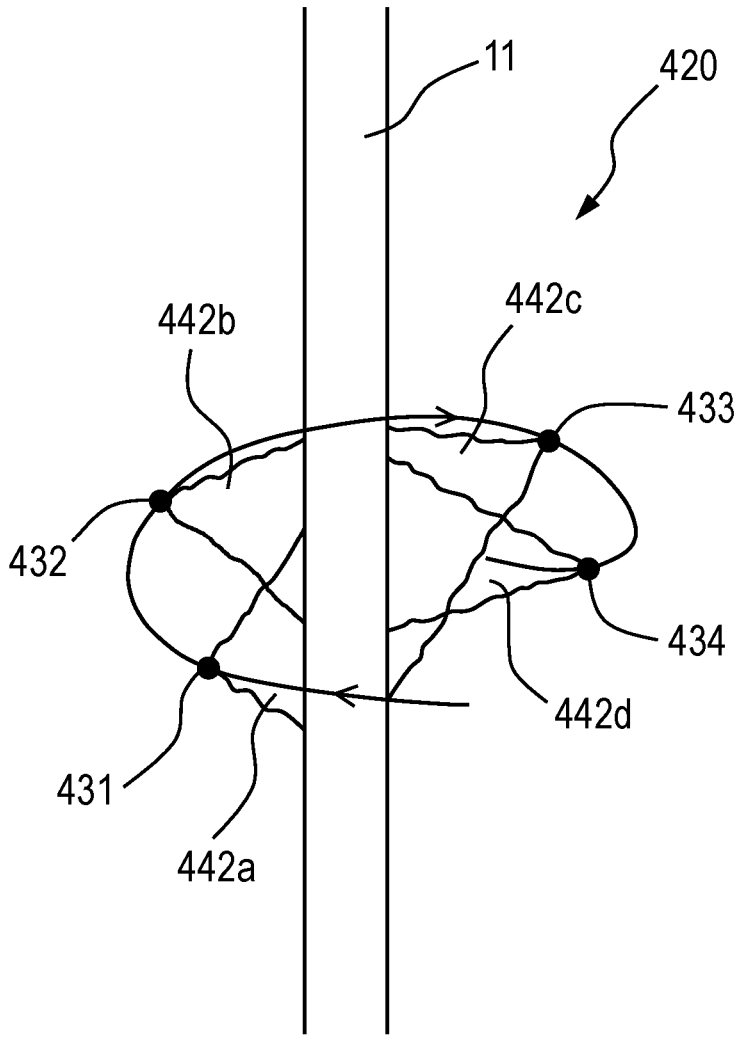
FIG. 13 is a schematic representation of an oriented group of fracture initiation points in accordance with an embodiment of the invention.

In the above-described embodiments, there is focus on placement of apexes and fracture initiation points in the same fracture plane, but it will be appreciated that in some formations and well geometries, other perforation geometries may be desirable. FIG. 13 is a schematic representation of a perforation arrangement 420, in which the relative positions of fracture initiation points 431, 432, 433, and 434 formed by perforation channels 442*a*, 442*b*, 442*c* and 442*d* respective, are arranged in a plane which is inclined with respect to a plane perpendicular to the wellbore.

In some perforation arrangements, it may be desirable to arrange at least some of the fracture initiation points in positions which facilitate a transition between an initial direction of fracture growth, and the principal fracture plane.

The invention provides a method and apparatus for perforating a wellbore in a hydraulic fracturing operation. In one aspect, the method comprises providing a perforating gun assembly having a first group of shaped charges on a first longitudinal portion of the assembly and a second group of shaped charges on a second longitudinal portion of the assembly. The orientations of the first and second groups are rotationally offset from one another around a longitudinal axis of the perforating gun assembly. The method comprises locating the perforating gun assembly in a wellbore with the first group of shaped charges adjacent a wall of the wellbore at a perforation location, and detonating the shaped charges to form a first perforation channel in the wellbore with a defined first fracture initiation point. The perforating gun assembly is translated in the wellbore to locate the second group of shaped charges oriented towards a defined second fracture initiation point, at a desired axial position with respect to the first fracture initiation point.

In one aspect, the method comprises providing a perforating gun assembly having a first group of shaped charges on a first longitudinal portion of the assembly and a second group of shaped charges on a second longitudinal portion of the assembly. The first group of shaped charges comprises at least two shaped charges arranged to generate jets oriented substantially along respective axes that converge towards one another in a first convergence plane, and the second group of shaped charges comprises at least two shaped charges arranged to generate jets oriented substantially along respective axes that converge towards one another in a second convergence plane. The first and second planes of convergence are rotationally offset from one another around a longitudinal axis of the perforating gun assembly. The method comprises locating the perforating gun assembly in a wellbore with the first group of shaped charges adjacent a wall of the wellbore at a perforation location, and detonating the shaped charges of the first group of shaped charges to form a first perforation channel in the wellbore with a defined first fracture initiation point. The perforating gun assembly is translated in the wellbore to locate the second group of shaped charges adjacent the wellbore at the perforation location such that the position of the second group of shaped charges orients the shaped charges towards a defined second fracture initiation point. The shaped charges of the second group are detonated to form a second perforation channel in the wellbore which overlaps with the first perforation channel in an axial direction of the wellbore, which is rotationally offset from the first perforation channel around a longitudinal axis of the wellbore, and which forms a defined second fracture initiation point at a desired axial position with respect to the first fracture initiation point.

In another aspect, a perforating gun assembly comprises a charge carrier having a longitudinal axis, a first group of shaped charges comprising at least two shaped charges arranged to generate jets oriented substantially along respective axes that converge towards one another in a first convergence plane to a first focal point, and a second group of shaped charges comprising at least two shaped charges arranged to generate jets oriented substantially along respective axes that converge towards one another in a second convergence plane to a second focal point. In at least one of the groups of shaped charges, a convergence angle between the orientation direction of two shaped charges within the group is selected to locate its focal point at a position which is axially offset from an axial midpoint between the outermost charges in the group.

The invention provides a perforating gun assembly and a method of use in hydraulic fracturing applications which addresses drawbacks and deficiencies of previously proposed apparatus and methods. In particular the invention in one of its aspects provides a multiple stage perforating gun assembly and a method of use in hydraulic fracturing applications which provides improved fracture initiation. Embodiments of the invention provide discrete fracture initiation sites with improved placement control and/or improved hydraulic efficiency.

Various modifications to the above-described embodiments may be made within the scope of the invention, and the invention extends to combinations of features other than those expressly claimed herein.

The invention claimed is:

1. A method of perforating a wellbore in a hydraulic fracturing operation, the method comprising:

providing a perforating gun assembly comprising a first group of shaped charges on a first longitudinal portion of the assembly and a second group of shaped charges on a second longitudinal portion of the assembly, wherein the first group of shaped charges comprises at least two shaped charges arranged to generate jets oriented substantially along respective axes that converge towards one another in a first convergence plane, and wherein the second group of shaped charges comprises at least two shaped charges arranged to generate jets oriented substantially along respective axes that converge towards one another in a second convergence plane, and wherein the first and second planes of convergence are rotationally offset from one another around a longitudinal axis of the perforating gun assembly;

locating the perforating gun assembly in a wellbore with the first group of shaped charges adjacent a wall of the wellbore at a perforation location;

detonating the shaped charges of the first group of shaped charges to form a first perforation channel in the wellbore with a defined first fracture initiation point;

after detonating the shaped charges of the first group of shaped charges, translating the perforating gun assembly in the wellbore to locate the second group of shaped charges adjacent the wellbore at the perforation location such that the position of the second group of shaped charges orients the shaped charges towards a defined second fracture initiation point; and detonating the shaped charges of the second group of shaped charges to form a second perforation channel in the wellbore which overlaps with the first perforation channel in an axial direction of the wellbore, which is rotationally offset from the first perforation channel around a longitudinal axis of the wellbore, and which forms a defined second fracture initiation point at a desired axial position with respect to the first fracture initiation point.

2. The method according to claim 1, wherein the rotational offset between the first and second convergence planes orients the first and second perforation channels at distinct azimuthal angles.

3. The method according to claim 1, wherein the first and second perforation channels cross cut a fracture plane.

4. The method according to claim 1, wherein the first and second convergence planes are oriented at 180 degrees.

5. The method according to claim 1, comprising forming at least one of the first or second perforation channels by detonating one or more large hole shaped charges, translating the perforating gun assembly, and detonating deep penetrating shaped charges to generate jets which pass through one or more large holes formed by the large hole shaped charges.

6. The method according to claim 5, comprising forming at least two deep penetration holes through the one or more large holes, wherein the at least two deep penetration holes intersect to provide a connected channel in the formation.

7. The method according to claim 1, comprising translating the perforating gun assembly by applying a force to at least a portion of the perforating gun assembly.

8. The method according to claim 7, wherein the force is a motive force from a downhole tractor which forms a part of the perforating gun assembly.

9. The method according to claim 7, wherein the motive force is a tensile force or a compressive force applied from surface.

10. The method according to claim 7, wherein the assembly comprises a pressure chamber, and wherein the method comprises applying the force by exposing the pressure chamber to wellbore pressure, thereby causing wellbore fluids to enter the chamber.

11. The method according to claim 1, wherein the assembly comprises at least one sealed chamber which is pressure isolated from the wellbore and comprises a liquid filled chamber in a first condition, and wherein the method comprises breaking or rupturing a seal to the sealed chamber to enable liquid to be expelled from the chamber.

12. The method according to claim 1, wherein at least one of the defined first and second fracture initiation points is located at a position which is axially offset from an axial midpoint between the outermost shaped charges in its respective group.

13. The method according to claim 1, wherein at least one of the defined first and second fracture initiation points is located on or close to a principal fracturing plane.

14. A method of perforating and fracturing a wellbore, the method comprising:

carrying out the method according to claim 1;

pumping a fracturing fluid into the wellbore to the perforation location and into the perforation channels; and initiating and propagating a fracture from the first and second fracture initiation points.

15. A perforating gun assembly comprising:

a first group of shaped charges on a first longitudinal portion of the assembly, the first group of shaped charges comprising at least two shaped charges arranged to generate jets oriented substantially along respective axes that converge towards one another in a first convergence plane;

a second group of shaped charges on a second longitudinal portion of the assembly, the second group of shaped charges comprising at least two shaped charges arranged to generate jets oriented substantially along respective axes that converge towards one another in a second convergence plane;

a first detonator for detonating the shaped charges of the first group of shaped charges to form a first perforation channel in a wellbore with a defined first fracture initiation point;

a second detonator for detonating the shaped charges of the second group of shaped charges to form a second perforation channel in the wellbore with a defined second, fracture initiation point, wherein the second perforation channel overlaps with the first perforation channel in an axial direction of the wellbore;

an anchor for securing the perforating gun assembly in the wellbore with the first group of shaped charges adjacent the wellbore at a perforation location; and a positioning and alignment module configured to translate the perforating gun assembly in the wellbore to a second axial position, which locates the second group of shaped charges adjacent the wellbore at the perforation location such that the position of the second group of shaped charges orients the shaped charges towards a defined second fracture initiation point;

wherein the first and second planes of convergence are rotationally offset from one another around a longitudinal axis of the perforating gun assembly;

and wherein, in the second axial position, the second group of shaped charges are oriented to form a second perforation channel in the wellbore which overlaps with the first perforation channel in an axial direction of the wellbore, which is rotationally offset from the first perforation channel around a longitudinal axis of the wellbore, and which forms a defined second fracture initiation point at a desired axial position with respect to the first fracture initiation point.

16. The perforating gun assembly according to claim 15, further comprising a plurality of collections of shaped charges, wherein each collection contains more than one group of shaped charges, and wherein each group of shaped charges interacts to form a perforation channel.

17. The assembly according to claim 16, wherein the groups of shaped charges within each collection are intermeshed or interlaced in a longitudinal direction of the assembly.

18. The assembly according to claim 16, wherein the groups of shaped charges within each collection are rotationally offset or phased around the longitudinal axis of the assembly.

19. The assembly according to claim 15, wherein one or more groups of shaped charges are arranged in a line parallel to the longitudinal axis of the assembly.

20. The assembly according to claim 15, wherein the first and second groups of shaped charges are arranged to form first and second perforation channels which overlap one another in an axial direction of the wellbore and are rotationally offset by 180 degrees.

21. The assembly according to claim 15, wherein the positioning and alignment module comprises a guide shaft and a guide housing and wherein the guide shaft is movable within the guide housing to translate the perforating gun assembly in the wellbore.

22. The assembly according to claim 15, wherein the assembly further comprises a downhole tractor and wherein the downhole tractor is configured to provide a motive force.

23. The assembly according to claim 15, wherein the positioning and alignment module comprises at least one sealed chamber comprising a seal which is operable to be broken or ruptured.

24. The assembly according to claim 15, wherein the positioning and alignment module comprises a pressure chamber filled with air at atmospheric pressure, wherein in a first condition the pressure chamber is sealed and isolated from a wellbore pressure and is at a pressure lower than a wellbore pressure, and wherein the pressure chamber is configured to permit wellbore fluids to enter the chamber upon exposure to wellbore pressure.

* * * * *